US005492222A

United States Patent [19]

Weaver

[11] Patent Number: 5,492,222

[45] Date of Patent: Feb. 20, 1996

[54] BAR CODE BLOCKING CARRIER

[75] Inventor: William N. Weaver, Northbrook, Ill.

[73] Assignee: Illinois Tool Works Inc., Glenview, Ill.

[21] Appl. No.: 226,886

[22] Filed: Apr. 13, 1994

[51] Int. Cl.[6] ..... B65D 85/00; G06K 19/00

[52] U.S. Cl. ..... 206/459.5; 206/150; 206/427; 235/487; 283/91; 283/901

[58] Field of Search ..... 206/427, 459.5, 206/150; 283/83, 901, 85, 91; 235/487, 491, 494, 468

[56] References Cited

U.S. PATENT DOCUMENTS

| | | | |
|---|---|---|---|
| 3,330,408 | 7/1967 | Wanderer | 206/150 |
| 4,359,633 | 11/1982 | Bianco | 235/468 |
| 4,431,693 | 2/1984 | Skukowski | 206/459.5 X |
| 4,669,611 | 6/1987 | Flaherty | 206/459.5 X |
| 4,827,114 | 5/1989 | Blachon | 235/487 |
| 4,850,488 | 7/1989 | Humbert | 206/459.5 |
| 4,941,573 | 7/1990 | Fuerstman | 206/459.5 |
| 5,218,192 | 6/1993 | Fujii et al. | 235/487 |

*Primary Examiner*—Bryon P. Gehman

*Attorney, Agent, or Firm*—Trexler, Bushnell, Giangiorgi & Blackstone, Ltd.

[57] ABSTRACT

A substantially transparent carrier for carrying a group of items, such as bottles which hold beverages, is made of a plastic material which includes a chemical blocking agent. The carrier includes a machine readable bar code thereon. Each item includes an individual machine readable bar code thereon which is at least partially covered by the carrier. The chemical blocking agent is capable of blocking, by reflection or absorption, light having a narrow wavelength "tuned" or selected to prevent the individual bar codes on the items from being read by a typical bar code reader beam while allowing the bar code on the carrier to be read.

14 Claims, 1 Drawing Sheet

BAR CODE BLOCKING CARRIER

BACKGROUND OF THE INVENTION

This invention is generally directed to a plastic carrier for a group of items, such as bottles which hold beverages. More particularly, the invention contemplates a substantially transparent plastic carrier which groups together the items and prevents individual bar codes on each item from being read by a typical laser bar code reader beam.

Bar codes are widely used on items so that information about the item, such as price, can be easily and quickly read by scanning the bar code with a bar code reader beam. When the bar code is scanned, the bar code number is input into a computer to retrieve stored information about the item.

When items are grouped together in a package for sale, each item typically includes an individual machine readable bar code. The package is additionally labelled with a bar code which corresponds to the price of the group of items.

In a package that has a substantially transparent carrier, e.g. a band type carrier as shown in U.S. Pat. Nos. 4,219,117 or 4,557,375, when the package is scanned for a price, a bar code from an individual item could be scanned instead of the bar code on the package itself. If this occurs, information which correlates to the individual item would be retrieved and the purchaser of the package will be charged the individual price instead of the group package price. This can result in significant losses to the seller.

The present invention is intended to overcome or minimize these problems.

OBJECTS AND SUMMARY OF THE INVENTION

A general object of the present invention is to provide a carrier for a group of items, such as bottles which hold beverages.

Another object of the present invention is to provide a transparent carrier which encircles the items and prevents individual bar codes on each item from being read by a typical laser bar code reader beam.

Briefly, and in accordance with the foregoing, the present invention discloses a substantially transparent carrier for carrying a group of items, such as bottles which hold beverages. The carrier is made of a plastic material which includes a chemical blocking agent therein and the package may also include a machine readable bar code thereon. Each individual item includes an individual machine readable bar code thereon which is at least partially covered by the carrier. The chemical blocking agent is "tuned" to be capable of blocking, by reflection or absorption, light having narrow wavelength bands of the typical bar code readers, e.g. approximately 630 nanometers for Helium/Neon bar code readers and about 670 nanometers for the newer technology solid state laser bar code readers, while allowing the bar code on the carrier to be read.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE PREFERRED EMBODIMENT

Figure 1:
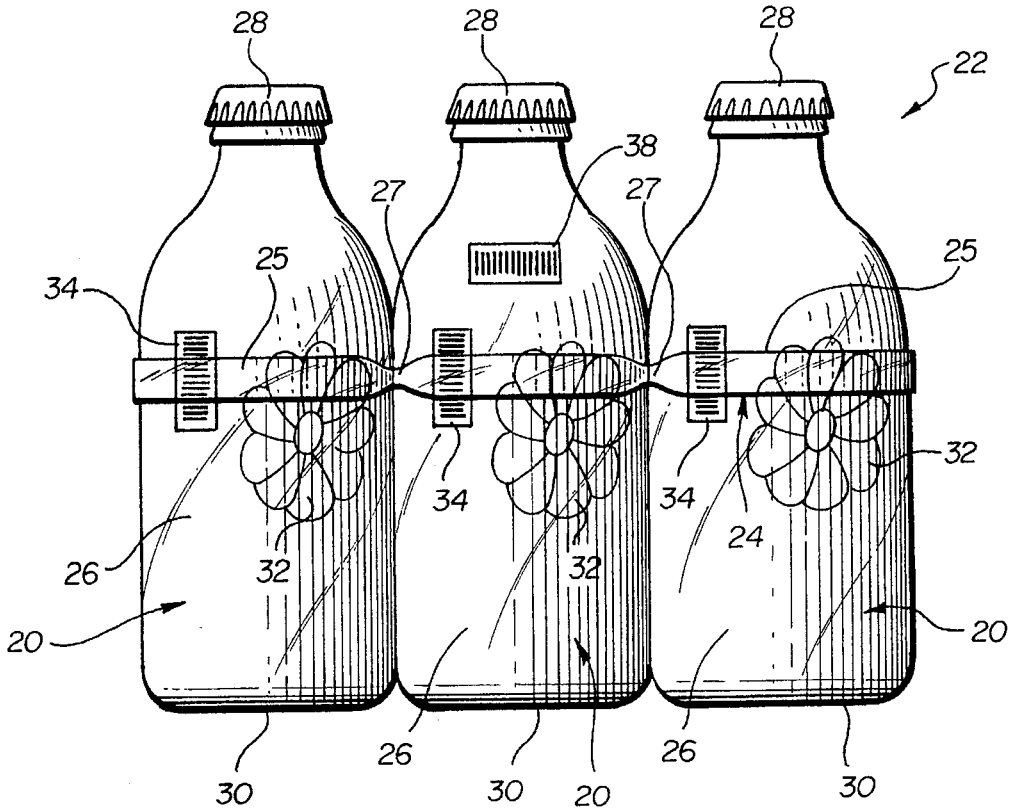
FIG. 1 is a perspective view of a package of bottles created together by a carrier which incorporates the features of the invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

As shown in FIG. 1, a plurality of items, e.g. bottles, 20 are grouped together and surrounded by a carrier 24. The items 20 shown in FIG. 1 are typical bottles which hold beverages, each of which include a cylindrical side wall 26 having an exterior face, a top 28 and a bottom wall 30. The exterior face of the side wall 26 can be decorated with graphics or writing 32 for aesthetics or identification of the product.

The exterior face of each item 20 also includes a machine readable bar code 34 printed thereon. The bar code 34 on each individual item 20 allows the item 20 to be scanned by a bar code reader (not shown). When the bar code 34 on the item 20 is scanned by a bar code reader, information, such as the price, about the individual item 20 is retrieved from a computer attached to the bar code reader.

The carrier 24 groups the items 20 together so that a group of items 20 may be sold as a package 22. The package 22 may have a machine readable bar code 38 on it, or alternatively a machine readable bar code may be on the carrier 24, which allows information about the package, such as the price of the group of items 20, to be retrieved when the bar code 38 is scanned by a bar code reader beam. The bar code 38 may be printed on the exterior of the package 22 or carrier 24 or otherwise affixed to the package 22 or carrier 24 by suitable means, such as adhesive.

The typical bar code scanner or reader (not shown) used today is a Helium/Neon laser bar code reader beam which emits light in a wavelength of about 630 nanometers to scan and read a bar code on an item or package. Newer technology solid state laser bar code readers emit light in a wavelength of about 670 nanometers.

Figure 2:
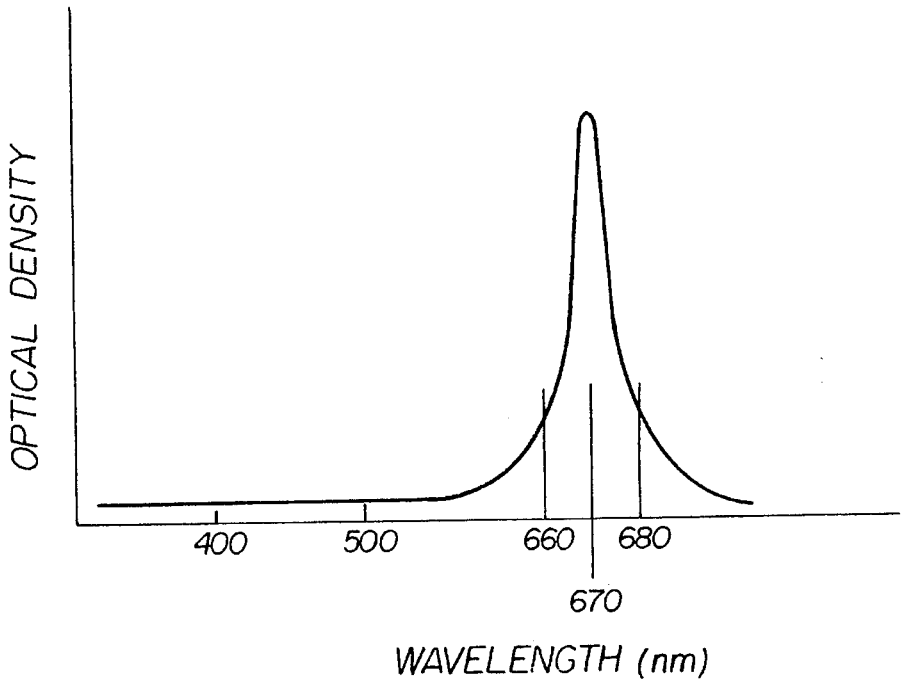
FIG. 2 is a graph plotting the wavelength of a typical solid state laser bar code reader versus optical density of the carrier.

The carrier 24 of the present invention is substantially transparent and is made of a suitable plastic material, such as low to medium density polyethylene. The plastic material includes a chemical blocking agent, such as a "dye," that alters the plastic material of the carrier 24 on a molecular level to change the optical density of the plastic material. As examples, Spectra Science Corporation Dye #1043, may be used as a chemical blocking agent. The amount of chemical blocking agent that is used in the present invention is an effective amount that will absorb or reflect light having a wavelength of about 660 to 680 nanometers from a typical solid state laser bar code reader beam. Such an effective amount is sufficient to either absorb or reflect the reader light beam so that the reader cannot read the bar codes 34 on the bottles 20 which are covered, at least partially by the carrier 24. As shown on the graph in FIG. 2, the optical density, when including dye of the type contemplated by the present invention, will selectively block the light at wavelengths between about 660 and 680 nanometers, which are the approximate wavelengths emitted from the solid state laser reader beam, by reflection or absorption.

The carrier 24 of the present invention is substantially transparent so as to not detract or obscure graphics or writing 32 on the bottles 20. By using a dye that varies the plastic material on a molecular level, rather than pigments comprising particles dispersed in the plastic, to change the optical density of the material, the substantial transparency of the plastic material is not altered. When particles, such as micas or metal oxides, are dispersed in the carrier transparency is compromised.

As shown in FIG. 1, the carrier 24 is made of a plurality of bands 25 which surround each individual bottle 20 and contacts each bottle 20 along its side wall 26. The bands are integrally joined at 27. To prevent the bar code 34 on an individual bottle 20 from being read by a bar code reader beam, the carrier 24 of the present invention is placed in a position along the side wall 26 which at least partially covers each bar code 34 on each individual bottle 20. It is within the scope of the invention that the carrier 24 completely covers the bar codes 34 on the individual bottles 20.

When the laser reader beam scans the package, the carrier material will absorb or reflect the light which is emitted by the laser reader. Thus, the covered bar codes 34 on the individual bottles 20 cannot be read by the reader.

The items 20 shown in FIG. 1 are typical bottles which hold beverages, however, it is to be understood that other types of items, such as boxes may be grouped together and surrounded by the carrier 24. Also, as shown in FIG. 1, the carrier 24 is a continuous band that encircles each bottle 20. It is to be understood that the carrier 24 may be of a variety of forms, such as a sheet of plastic formed to fit around the items.

While a preferred embodiment of the present invention is shown and described, it is envisioned that those skilled in the art may devise various modifications of the present invention without departing from the spirit and scope of the appended claims. The invention is not intended to be limited by the foregoing disclosure.

The invention claimed is:

1. A carrier for carrying a group of items, each item including an individual machine readable bar code thereon, said carrier comprising a plastic material including an effective amount of a chemical blocking agent therein for blocking bar code reader light having a narrow wavelength, said chemical blocking agent altering the plastic material on a molecular level for blocking said light, said carrier being substantially transparent and extending around said items to create a package such that said individual machine readable bar codes are at least partially covered by said carrier.

2. A carrier as defined in claim 1, wherein said transparent plastic material is polyethylene.

3. A carrier as defined in claim 1, wherein said chemical blocking agent is a dye which alters the plastic material on a molecular level and blocks light transmitted at a narrow band width consistent with the band width of a bar code reader.

4. A carrier as defined in claim 1, wherein said package also includes a separate machine readable bar code thereon.

5. A carrier as defined in claim 1, wherein the carrier is a band type carrier including band segments gripping individual items.

6. A carrier as defined in claim 1, wherein said effective amount of the chemical blocking agent blocks light having a wavelength between the range of about 660 to 680 nanometers.

7. A carrier as defined in claim 1, wherein said chemical blocking agent is effective for absorbing said light.

8. A carrier as defined in claim 1, wherein said chemical blocking agent is effective for reflecting said light.

9. A package comprising: a plurality of containers; a machine readable bar code on each of said containers; a carrier comprising a plurality of band segments, said band segments gripping said containers, said carrier comprising a plastic material including an effective amount of a chemical blocking agent therein which alters the plastic material on a molecular level and blocks light transmitted at a narrow band width consistent with the band width of a bar code reader, said carrier being substantially transparent and extending around said containers, said band segments only partially covering said machine readable bar codes on said containers.

10. A package as defined in claim 9, wherein said chemical blocking agent is effective for absorbing said light.

11. A package as defined in claim 9, wherein said chemical blocking agent is effective for reflecting said light.

12. A package as defined in claim 9, wherein said transparent plastic material is polyethylene.

13. A package as defined in claim 9, further including a separate machine readable bar code on said package, said separate machine readable bar code not being covered by said carrier.

14. A carrier as defined in claim 9, wherein said chemical blocking agent is a dye and said effective amount of the chemical blocking agent blocks light having a wavelength between the range of about 660 to 680 nanometers.

* * * * *